US009890903B2

(12) United States Patent
Xiang et al.

(10) Patent No.: US 9,890,903 B2
(45) Date of Patent: Feb. 13, 2018

(54) HIGH PURITY PHOSPHORUS OXYCHLORIDE SAFE FEEDING SYSTEM

(71) Applicant: Dong Xiang, Guiyang (CN)

(72) Inventors: Dong Xiang, Guiyang (CN); Xiaoji Shu, Guiyang (CN); Xianwei Pan, Guiyang (CN)

(73) Assignee: Dong Xiang, Guiyang (CN)

( * ) Notice: Subject to any disclaimer, the term of this patent is extended or adjusted under 35 U.S.C. 154(b) by 84 days.

(21) Appl. No.: 14/898,715

(22) PCT Filed: Jun. 17, 2014

(86) PCT No.: PCT/CN2014/080089

§ 371 (c)(1),
(2) Date: Dec. 15, 2015

(87) PCT Pub. No.: WO2014/201996

PCT Pub. Date: Dec. 24, 2014

(65) Prior Publication Data

US 2016/0138760 A1 May 19, 2016

(30) Foreign Application Priority Data

Jun. 19, 2013 (CN) ..... 2013 2 0351139 U

(51) Int. Cl.
*F04F 1/18* (2006.01)
*F17C 9/00* (2006.01)
*F17C 3/00* (2006.01)

(52) U.S. Cl.
CPC ..... *F17C 9/00* (2013.01); *F17C 3/00* (2013.01); *F17C 2205/0111* (2013.01);
(Continued)

(58) Field of Classification Search
CPC ..... Y10T 137/3115; F17C 9/00; F17C 3/00; F17C 2205/0332; F17C 2223/0153;
(Continued)

(56) References Cited

U.S. PATENT DOCUMENTS 2,970,604 A * 2/1961 Henry ..... F17C 13/02 137/206
3,110,157 A * 11/1963 Radd ..... F16L 55/00 137/312

(Continued)

FOREIGN PATENT DOCUMENTS

CN 1645429 A 7/2005
CN 201776077 U 3/2011

(Continued)

OTHER PUBLICATIONS

International Search Report and Written Opinion in corresponding PCT Application No. CN2014/080089, dated Sep. 22, 2014.

*Primary Examiner* — Craig J Price
(74) *Attorney, Agent, or Firm* — Leason Ellis LLP

(57) ABSTRACT

A high-purity phosphorus oxychloride safety feed system improves continuity and intelligent control of operation and usage, addresses alarm reporting, takes measures when leakage of high purity phosphorus oxychloride occurs, and solves problem of on-site and remote monitoring and material liquid level monitoring during use. The feeding device is provided with: an automatic tail gas exhaust outlet, a high purity phosphorus oxychloride gas leakage detection alarm, a video surveillance camera, a low liquid level detection alarm, an LED illuminating lamp, and an observation window.

3 Claims, 2 Drawing Sheets

(52) U.S. Cl.
CPC ..... *F17C 2205/0332* (2013.01); *F17C 2223/0153* (2013.01); *F17C 2223/033* (2013.01); *F17C 2223/047* (2013.01); *F17C 2250/032* (2013.01); *F17C 2250/038* (2013.01); *F17C 2250/0408* (2013.01); *F17C 2250/0452* (2013.01); *F17C 2260/037* (2013.01); *F17C 2260/038* (2013.01); *F17C 2260/042* (2013.01); *F17C 2270/05* (2013.01); *Y10T 137/3115* (2015.04)

(58) Field of Classification Search
CPC ..... F17C 2223/033; F17C 2223/047; F17C 2250/032; F17C 2250/038; F17C 2250/0408; F17C 2250/0452; F17C 2260/037; F17C 2260/038; F17C 2260/042; F17C 2270/05; F17C 2205/0111
USPC ..... 137/206, 209
See application file for complete search history.

(56) References Cited

U.S. PATENT DOCUMENTS

| | | | | |
|---|---|---|---|---|
| 8,561,631 | B2 * | 10/2013 | Yung | B63B 25/14 137/206 |
| 2011/0078918 | A1 * | 4/2011 | Koura | B01D 1/14 34/427 |

FOREIGN PATENT DOCUMENTS

| | | | |
|---|---|---|---|
| CN | 201827656 | U | 5/2011 |
| CN | 202546241 | U | 11/2012 |
| CN | 203307042 | U | 11/2013 |
| JP | 0885589 | A | 4/1996 |

* cited by examiner

HIGH PURITY PHOSPHORUS OXYCHLORIDE SAFE FEEDING SYSTEM

CROSS-REFERENCE TO RELATED PATENT APPLICATIONS

This application is a U.S. National Phase Application under 35 U.S.C. § 371 of International Patent Application No. PCT/CN2014/080089, filed Jun. 17, 2014, and claims priority of Chinese Application No. CN 201320351139.1, filed Jun. 19, 2013, all of which are incorporated by reference in their entireties. The International Application was published on Dec. 24, 2014 as International Publication No. WO 2014/201996 A1.

TECHNICAL FIELD

The utility model relates to a phosphorus oxychloride safety feeding device, and particularly to a high purity phosphorus oxychloride safety feeding device used in diffusion process of solar cells.

BACKGROUND ART

High purity phosphorus oxychloride (99.9999%-99.99999%) is one of the key basic chemical materials in manufacturing process of solar cell, and is mainly used in N type doping of solar cell; its purity and cleanliness have great influence on finished product rate, electrical performance and reliability of solar cell, but it is a colorless transparent chemical material with strong corrosivity, oxidability, high toxicity, and violent reactivity with water. Chinese patent CN202546241U discloses a high-purity phosphorus oxychloride safety feeding device, wherein its structure is: a high-purity phosphorus oxychloride storage tank in a thermostat is connected with a nitrogen inlet pipe and a nitrogen outlet pipe, and a temperature digital display meter is provided on the thermostat; one end of the nitrogen inlet pipe is inserted into the bottom part of the high-purity phosphorus oxychloride storage tank, and the other end thereof is connected with a nitrogen valve. The system completely avoids the explosion risk generated when the high-purity phosphorus oxychloride meets water, improves safety of the high-purity phosphorus oxychloride in use and reduces the production and maintenance costs of the phosphorus oxychloride user and the logistics cost of the high-purity phosphorus oxychloride supplier; however, the shortcomings of the system are as below: it can not carry out the remote monitoring on the using site of the high-purity phosphorus oxychloride and the accurate monitoring of material liquid level; cannot timely alarm and handle when the high-purity phosphorus oxychloride is leaked; cannot process the nitrogen pressure release problem caused by a man-made maloperation (the air outlet valve is not opened when opening the nitrogen gas valve); therefore, the system has various hidden troubles in production safety; its production safety and working efficiency are low.

SUMMARY OF UTILITY MODEL

The utility model aims to provide a high-purity phosphorus oxychloride safety feeding device which is simple in structure, safe and reliable, high in efficiency, free from leakage and pollution, convenient to use, and low in running cost.

The purpose of the utility model is realized in this way: a temperature digital display meter is provided on the feeding device, a high-purity phosphorus oxychloride storage tank is arranged in the feeding device; one end of a nitrogen inlet pipe connected with a nitrogen inlet valve is plugged into the bottom part of the high-purity phosphorus oxychloride storage tank, and the other end thereof out of the feeding device is connected with a nitrogen valve; one end of a nitrogen outlet pipe connected with a nitrogen inlet valve is plugged into the top part of the high-purity phosphorus oxychloride storage tank, the other end thereof is located out of the feeding device; an automatic tail gas exhaust opening is arranged on the feeding device, and the upper part of an inner wall of the feeding device is equipped with a high-purity phosphorus oxychloride leakage detection alarm; the middle part of the inner wall is equipped with a video monitoring camera, and the lower part of the inner wall is equipped with a low liquid-level monitoring alarm and connected with a computer port on the feeding device; the bottom part in the feeding device is equipped with an LED (light-emitting diode) floodlight, and the front side of the feeding device is provided with an observing window.

The nitrogen inlet pipe in the feeding device is connected with a pressure release valve.

A pressure release valve is connected in between the nitrogen inlet pipe and the nitrogen outlet pipe in the feeding device.

For employing above structures, the utility model enhances continuity and intellectual control of its operation and use; solves the alarm and handling measures when the high-purity phosphorus oxychloride is leaked in use under emergency situations; solves the nitrogen pressure release problem caused by man-made maloperation (the air outlet valve is not opened when opening the nitrogen gas valve); and solves the on-site and remote monitoring, material liquid level monitoring problems when the high-purity phosphorus oxychloride is in use.

DESCRIPTION OF ACCOMPANYING DRAWINGS

Figure 1:
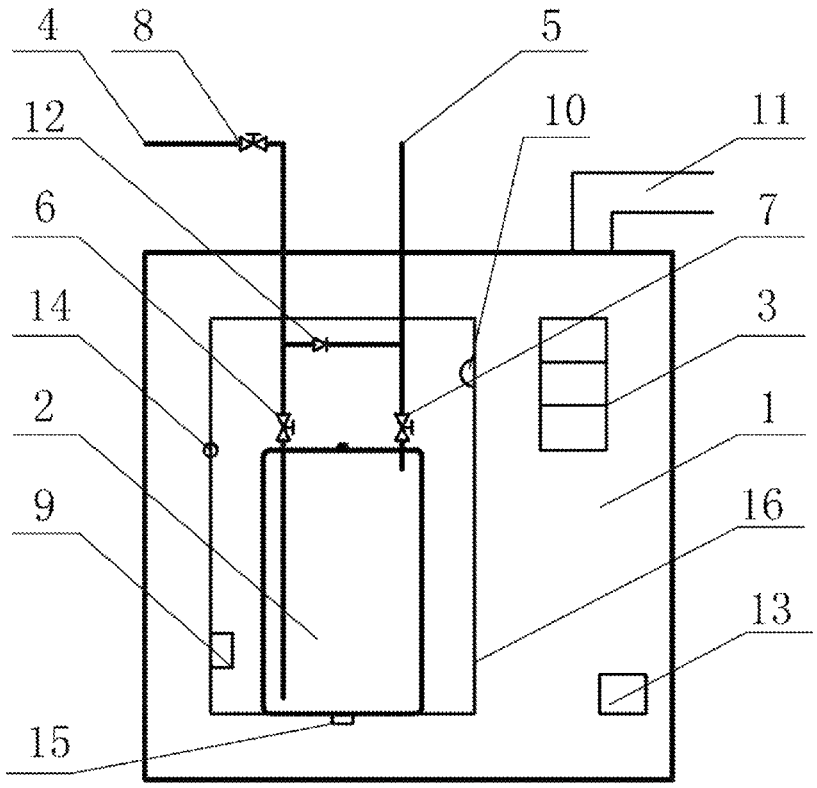
FIG. 1 is a schematic structural view of the first embodiment of the utility model.
Figure 2:
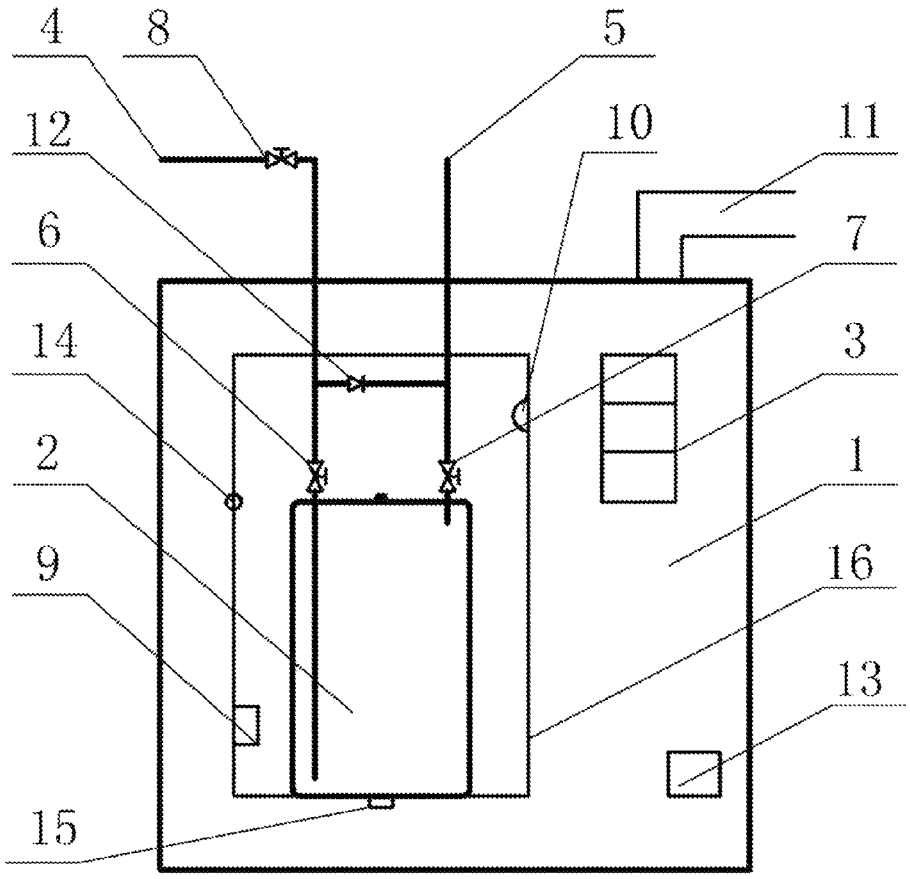
FIG. 2 is a schematic structural view of the second embodiment of the utility model.

Figures include 1 feeding device, 2 high-purity phosphorus oxychloride storage tank, 3 temperature digital display meter, 4 nitrogen inlet pipe, 5 nitrogen outlet pipe, 6 nitrogen inlet valve, 7 nitrogen outlet valve, 8 nitrogen valve, 9 low liquid level monitoring alarm, 10 high-purity phosphorus oxychloride gas leakage detection alarm, 11 automatic tail gas exhaust opening, 12 pressure release valve, 13 computer port, 14 monitoring video camera, 15 LED floodlight, 16 observation window.

SPECIFIC IMPLEMENTATION MODES

Embodiment I: the temperature digital display meter 3 is provided on the feeding device 1, the high-purity phosphorus oxychloride storage tank 2 is arranged in the feeding device 1; one end of the nitrogen inlet pipe 4 connected with a nitrogen inlet valve 6 is plugged into the bottom part of the high-purity phosphorus oxychloride storage tank 2, and the other end thereof out of the feeding device is connected with the nitrogen valve 8; one end of the nitrogen outlet pipe 5 connected with the nitrogen outlet valve 7 is plugged into the top part of the high-purity phosphorus oxychloride storage tank 2, and the other end thereof is arranged at outside of the feeding device 1; the automatic tail gas exhaust opening 11 is arranged on the feeding device 1, and the upper part of an inner wall of the feeding device 1 is equipped with the high-purity phosphorus oxychloride leakage detection alarm 10; the middle part of the inner wall is equipped with the monitoring video camera 14, and the lower part of the inner wall is equipped with the low liquid level monitoring alarm 9 and connected with the computer port 13 of the feeding device 1; the front side of the feeding device is provided with the observation window 16, the nitrogen inlet pipe 4 in the feeding device is connected with the pressure release valve 12, and the bottom part in the feeding device is equipped with the LED floodlight 15.

The feed device 1 takes air as the heat exchange medium, the accuracy of its constant temperature is +/−0.1 DEG C., and uniformity thereof is 0.3 DEG C.; the constant temperature can be accurately maintained. The tank body and the valve of the high-purity phosphorus oxychloride storage tank 2 are made of high-purity fusible Teflon® (PFA) material, the valve adopts a rotary plug valve, and the valve is connected with the pipeline by an expanding opening; the valve is good in sealing property, convenient to operate, and clear in valve position indication. One end of the nitrogen inlet pipe 4 in the high-purity phosphorus oxychloride storage tank 2 is plugged at the bottom part of the high-purity phosphorus oxychloride storage tank 2, and the other end is connected with the nitrogen valve 8, the pressure release valve 12 is connected in between the high-purity phosphorus oxychloride storage tank 2 and the nitrogen valve 8; the released nitrogen enters the device exhaust system; when in use, the tank body or the valve of the high-purity phosphorus oxychloride storage tank will not be damaged by a mal-operation. The phosphorus oxychloride gas leakage detection alarm 10, the low liquid-level monitoring alarm 9, the monitoring video camera 10, and the LED floodlight 15 are further provided in the feeding device 1 so as to remotely observe the using conditions of the materials and thus realize an on-line concentrated monitoring.

The system makes the phosphorus source in an enclosed environment; one side of the feeding device 1 is provided with the tail gas exhaust opening 11 which is connected with the diffusion furnace tail gas processing facility; when a leakage happens, the system will automatically make an alarm and start the exhaust system, so as to discharge the leaked high-purity phosphorus oxychloride into the diffusion furnace tail gas processing facility. The phosphorus oxychloride gas leakage detection alarm 10, the monitoring video camera 14, the low liquid-level monitoring alarm 9 and automatic tail gas processing device of the feeding device 1 are connected to the computer port 13. The temperature digital display meter 3 is provided on the feeding device, and used for accurately setting, adjusting and controlling temperature of the constant temperature system. A plurality of holes of the constant temperature part connected to exterior are arranged on the box body of the feeding device 1 and used for meeting the requirement of nitrogen pipe 4 access, and for providing a complete sealing effect between the pipeline and the box body of the feeding device 1 after the pipeline being connected. The feeding device 1 can be designed to be one-barrel package, two-barrel package, and multi-barrel package according to the differences of various solar cell diffusion devices.

The high-purity phosphorus oxychloride storage tank 2 is made of high-purity PFA which is corrosive-resistant, collision-resistant, wear-resistant and high temperature resistant. The volume can be divided into 5 L, 10 L, 20 L and other specifications according to the actual using condition. The top part of the high-purity phosphorus oxychloride storage tank 2 is provided with an air outlet, an air inlet and a feeding opening; the air inlet is extended from the nitrogen inlet pipe 4 of the high-purity phosphorus oxychloride storage tank 2 to the bottom part of the high-purity phosphorus oxychloride storage tank 2; both the air inlet and air outlet are provided with PFA rotary plug valves in order to prevent material leakage and facilitate pipeline installation. The high-purity phosphorus oxychloride storage tank 2 passes through the safety certificate of the United Nations (U.N.) UN organization, and can guarantee the safety and validity of transportation and use thereof.

Its use in one solar cell manufacturer is taken as an example.

The supplier manufacturer has completed the filling of the high-purity phosphorus oxychloride storage tank 2 and then safely transported it to the high-purity phosphorus oxychloride user.

The device is connected with the production system of the user.

The high-purity phosphorus oxychloride storage tank 2 is placed in the feeding device 1, and the nitrogen inlet valve 6 on the high-purity phosphorus oxychloride storage tank 2 is connected with the nitrogen inlet pipe 4; the other end of the nitrogen inlet pipe 4 is connected with the nitrogen valve 8; the nitrogen outlet valve 7 is connected with the nitrogen outlet pipe 5, the other end of the nitrogen outlet pipe 5 is connected with a diffusion furnace, and one end of the pressure release valve 12 is connected with the automatic tail gas exhaust opening 11.

The constant temperature system of the feeding device 1 is started, the temperature is set at 20 DEG C.; with an observation through the temperature digital display meter 3 that the temperature in the feeding device 1 is at 20 DEG C. constantly, the nitrogen outlet valve 7 and the nitrogen inlet valve 6 are opened sequentially; and then the nitrogen valve 8 connected with the system is opened, and then the system can be used.

The feeding device 1 is internally provided with the low liquid-level monitoring alarm 9; when the liquid level is declined to the set alarming liquid level after material consumption, the low liquid-level monitoring alarm 9 will automatically issues an alarm to remind of replacing materials.

The feeding device 1 is internally provided with the high-purity phosphorus oxychloride gas leakage detection alarm 10; when the materials are leaked when in use and the detected leakage level reaches the set alarm value, the detection alarm will automatically issue an alarm to remind users for checking and maintaining.

One side of the feeding device 1 is provided with the tail gas exhaust opening 11, which is connected with the tail gas processing facility and thus can automatically process the leaked tail gas.

Through turning on the LED floodlight 15, the using condition of the materials can be observed through the observation window 16 or the monitoring video camera 14.

After replacing the material, the device can be repeatedly used.

Embodiment II: the temperature digital display meter 3 is provided on the feeding device 1, the high purity phosphorus oxychloride storage tank 2 is arranged in the feeding device 1; one end of the nitrogen inlet pipe 4 connected with a nitrogen inlet valve 6 is plugged into the bottom part of the high purity phosphorus oxychloride storage tank 2, and the other end thereof out of the feeding device is connected with the nitrogen valve 8; one end of the nitrogen outlet pipe 5 connected with the nitrogen outlet valve 7 is plugged into the top part of the high purity phosphorus oxychloride storage tank 2, and the other end thereof is arranged on outside of the feeding device 1; the automatic tail gas exhaust opening 11 is arranged on the feeding device 1, and the upper part of an inner wall of the feeding device 1 is equipped with the high purity phosphorus oxychloride leakage detection alarm 10; the middle part of the inner wall is equipped with the monitoring video camera 14, and the lower part of the inner wall is equipped with the low liquid-level monitoring alarm 9, which are connected with the computer port 13 on the feeding device 1; the front side of the feeding device is provided with the observation window 16, the nitrogen inlet pipe 4 and the nitrogen inlet pipe 5 in the feeding device are connected with the pressure release valve 12, and the bottom part in the feeding device is equipped with the LED floodlight 15.

The high purity phosphorus oxychloride storage tank 2 is placed in the feeding device 1, and the upper end of the high-purity phosphorus oxychloride storage tank 2 is connected with the nitrogen inlet valve 6, the nitrogen outlet valve 7 and a charging and discharging opening; the shunt pipeline between the nitrogen inlet pipe 6 and the nitrogen valve 8 is connected with the pressure release valve 12, and the nitrogen released will enter the diffusion furnace and thus has not influence on the diffusion device. One side of the feeding device 1 is provided with the automatic tail gas exhaust opening, and the feeding device 1 is further configured with the precise constant temperature system, the low liquid-level monitoring alarm 9, the high purity phosphorus oxychloride gas leakage detection alarm 10, the monitoring video camera 14, the observation window 16 and the LED floodlight 15.

The feeding device 1 uses air as heat exchange medium, the accuracy of the constant temperature is +/−0.1 DEG C., and the uniformity thereof is 0.3 DEG C.; the constant temperature can be accurately maintained. The tank body and the valves of the high-purity phosphorus oxychloride storage tank are made of high purity fusible Teflon® (PFA) material, the valves adopts a rotary plug valve, and the valves are connected with the pipeline by an expanding opening; the valves are good in sealing property, convenient to operate, and clear in valve position indication. One end of the nitrogen inlet pipe 4 in the high purity phosphorus oxychloride storage tank 2 is plugged at the bottom part of the high purity phosphorus oxychloride storage tank 2, and the other end thereof is connected with the nitrogen valve 8, the pressure release valve 12 is connected in between the high-purity phosphorus oxychloride storage tank 2 and the nitrogen valve 8; the released nitrogen enters the device exhaust system; the tank body or the valve of the high-purity phosphorus oxychloride storage tank thus will not be damaged by a mal-operation when in use. The phosphorus oxychloride gas leakage detection alarm 10, the low liquid-level monitoring alarm 9, the monitoring video camera 10, and the LED floodlight 15 are arranged in the feeding device 1 so as to remotely observe the using conditions of the materials and realize the on-line concentrated monitoring.

The system makes the phosphorus source in an enclosed environment; one side of the feeding device 1 is provided with the tail gas exhaust opening 11 which is connected with the diffusion furnace tail gas processing facility; when a leakage happens, the system will automatically issue an alarm and start the exhaust system, so as to discharge the leaked high purity phosphorus oxychloride into the diffusion furnace tail gas processing facility. The phosphorus oxychloride gas leakage detection alarm 10, the monitoring video camera 14, the low liquid-level monitoring alarm 9 and automatic tail gas processing device are connected with the computer port 13. The temperature digital display meter 3 is arranged on the feeding device, and used for accurately setting, adjusting and controlling temperature of the constant temperature system. A plurality of holes of the constant temperature part for connecting to exterior are arranged on the box body of the feeding device 1 and used for meeting the requirement of nitrogen pipe 4 access, and for providing a complete sealing effect between the pipeline and the box body of the feeding device 1 after the pipeline being connected. The feeding device 1 can be designed to be one-barrel package, two-barrel package, and multi-barrel package according to the difference of the battery slice diffusion device.

The high purity phosphorus oxychloride storage tank 2 is made of high purity PFA which is corrosive-resistant, collision-resistant, wear-resistant and high temperature-resistant. The volume can be divided into 5 L, 10 L, 20 L and other specifications according to the actual using condition. The top part of the high purity phosphorus oxychloride storage tank 2 is provided with an air outlet, an air inlet and a feeding opening; the air inlet is extended from the nitrogen inlet pipe 4 of the high purity phosphorus oxychloride storage tank 2 to the bottom part of the high purity phosphorus oxychloride storage tank 2; the air inlet and air outlet are provided with PFA rotary plug valves in order to prevent material leakage and facilitate pipeline installation. The high purity phosphorus oxychloride storage tank 2 passes through the safety certificate of the United Nations (U.N.) UN organization, and can guarantee the safety and validity of transportation and use.

The invention claimed is:

1. A high purity phosphorus oxychloride safety feeding system, a feeding device having a temperature digital display meter, the feeding device having a high-purity phosphorus oxychloride storage tank in the feeding device, one end of a nitrogen inlet pipe connected with a nitrogen inlet valve in communication with a bottom part of the high purity phosphorus oxychloride storage tank, an opposite end of the nitrogen inlet pipe out of the feeding device being connected with a nitrogen valve; one end of a nitrogen outlet pipe connected with a nitrogen outlet valve being plugged into a top part of the high-purity phosphorus oxychloride storage tank, and an opposite end of the nitrogen outlet pipe is located out of the feeding device, the high purity phosphorus oxychloride safety feeding system is characterized in that an automatic tail gas exhaust opening is arranged on the feeding device, an upper part of an inner wall of the feeding device is equipped with a high purity phosphorus oxychloride leakage detection alarm, a middle part of the inner wall is equipped with a monitoring video camera, and a lower part of the inner wall is equipped with a low liquid-level monitoring alarm, which are connected with a computer port on the feeding device, a bottom part in the feeding device is equipped with an light-emitting diode floodlight, and a front side of the feeding device is provided with an observation window.

2. The high purity phosphorus oxychloride safety feeding system according to claim 1, which is characterized in that the nitrogen inlet pipe in the feeding device is connected with a pressure release valve.

3. The high purity phosphorus oxychloride safety feed system according to claim 1, which is characterized in that a pressure release valve is connected in between the nitrogen inlet pipe and the nitrogen outlet pipe in the feeding device.

* * * * *